United States Patent [19]

Giudici

[11] Patent Number: 4,668,203

[45] Date of Patent: May 26, 1987

[54] METHOD AND APPARATUS FOR DETECTING EVAPORATION OF GETTER MATERIAL DURING MANUFACTURE OF A CATHODE-RAY TUBE, ESPECIALLY FOR TELEVISION

[75] Inventor: Giuliano Giudici, Rome, Italy

[73] Assignee: Videocolor, Montrouge, France

[21] Appl. No.: 804,597

[22] Filed: Dec. 4, 1985

[30] Foreign Application Priority Data

Dec. 7, 1984 [FR] France ..... 84 18777

[51] Int. Cl.[4] ..... H01J 9/42

[52] U.S. Cl. ..... 445/6; 445/55

[58] Field of Search ..... 445/3, 55, 63, 6; 324/404

[56] References Cited

U.S. PATENT DOCUMENTS 2,141,644 12/1938 Eddison ..... 445/55
2,861,861 11/1958 Hoffmann ..... 445/63
3,227,506 1/1966 De Backer ..... 445/55 X
4,038,616 7/1977 Ball ..... 445/63 X
4,445,872 5/1984 Ottos ..... 445/3

FOREIGN PATENT DOCUMENTS 74038 6/1980 Japan ..... 445/3

OTHER PUBLICATIONS

Le Vide, No. 109, Jan.-Feb. 1964, pp. 631-637, Paris, France; P. Meyerer.

*Primary Examiner*—Kenneth J. Ramsey
*Attorney, Agent, or Firm*—Oblon, Fisher, Spivak, McClelland & Maier

[57] ABSTRACT

A method for checking the evaporation of a pellet of getter material such as barium on the walls of the envelope of a cathode-ray tube during manufacture. The pressure within the cathode-ray tube is measured during the operation involving stabilization of the cathode material by measuring the positive-ion charge within the tube.

8 Claims, 4 Drawing Figures

METHOD AND APPARATUS FOR DETECTING EVAPORATION OF GETTER MATERIAL DURING MANUFACTURE OF A CATHODE-RAY TUBE, ESPECIALLY FOR TELEVISION

BACKGROUND OF THE INVENTION

1. Field of the Invention

This invention relates to a method and to an apparatus for detecting whether the getter material has been correctly evaporated during manufacture of a cathode-ray tube and especially a picture tube for color television.

2. Description of the Prior Art

A cathode-ray tube (CRT) is formed by an evaporated glass envelope having a front portion known as a faceplate which forms a screen. The faceplate is joined by means of a funnel-shaped portion to the rear cylindrical portion known as a neck, the electron gun or guns being housed at the end of said neck.

The final stages of manufacture of the picture tube are as follows: a cup containing the getter material to be evaporated is attached to the electron gun which is installed within the envelope. There then follow the successive steps of evacuation of the envelope by pumping, evaporation of the getter material by means of a heating induction coil, heating of the cathode or cathodes to a temperature which is higher than the usual operating temperature in order to form and stabilize the cathode material. Voltages are then applied to the grids of the electron gun with a view to cleaning the tube or in other words removing the undesirable gas particles which are absorbed by the getter material. If this material has not evaporated, the picture tube thus fabricated will not be capable of operating correctly by reason of the poor quality of vacuum but primarily by reason of the presence of positive ions which will be attracted by the cathode and cause damage to this latter.

It has been found that, in mass-production lines, evaporation of getter material does not take place correctly in about 1% of cathode-ray tubes being manufactured. Tubes which exhibit this defect then have to be reprocessed or in other words withdrawn from the production line and returned to the getter evaporation station. This incident may have a number of different causes: error of operator, faulty positioning of the induction heating coil employed for the evaporation process, faulty coil or current supply source, and so on.

Up to the present time, evaporation of getter material has been checked by visual observation of the tube walls. This type of checking operation is not wholly reliable since the operator may fail to detect a transient evaporation fault as a result of inattention. It should be added that visual observation is a tedious operation.

The invention described below provides a remedy for the drawbacks outlined in the foregoing.

SUMMARY OF THE INVENTION

The present invention essentially consists in measuring the pressure which prevails within the cathode-ray tube during stabilization of the cathode material and in returning the tube to the getter-material evaporation station if the pressure exceeds a predetermined value such as $2\times10^{-4}$ Torr. To this end, in an embodiment which is particularly simple to apply in practice, the positive-ion charge is measured since the positive ions alone present a potential hazard to the cathode. Consideration could also be given to measurement of the negative-ion charge. However, this measurement would be difficult to perform in practice since the cathode produces electrons during stabilization of the cathode material and the charge produced by these electrons is added to the negative-ion charge and cannot be separated from this latter. In consequence, a measurement of the negative charge would not correctly represent the pressure within the cathode-ray tube.

In order to carry out said measurement of the positive-ion charge in one example, a positive potential is applied to one of the electrodes, in particular the grid $G_2$ of the electron gun and a negative potential is applied to another electrode such as the grid $G_3$ which forms part of the electrostatic lens. The electric current is measured as it passes between the electrode which is brought to a negative potential and ground. This current intensity represents the positive ion charge within the cathode-ray tube and therefore the pressure. It is important to note that the cathode is not required for the purpose of measurement. In point of fact, if a negative potential were applied to the cathode, it would attract positive ions and thus sustain damage. It has been found that, if the negative potential applied to the electrode $G_3$ is $-22.5$ V, and when a period of ten to fifteen minutes has elapsed after formation of the cathode material, the intensity of the current which flows through the grid $G_3$ exceeds 150 nanoamperes (which corresponds to a pressure of $2\times10^{-4}$ Torr) if the getter material has failed to spread by evaporation over the tube walls but is of the order of 25 nanoamperes (namely 4 to $5\times10^{-5}$ Torr) if this evaporation has in fact taken place. The cathode-ray tube which is undergoing treatment is thus returned to the getter-material evaporation station if the intensity between the electrode $G_3$ and ground exceeds 150 nanoamperes.

The generator which applies a positive potential to one of the electrodes should preferably be a constant-current generator in order to ensure that the intensity of the measurement current is not affected or little affected by the differences in characteristics between individual cathode-ray tubes, these differences or dispersions being inherent in a mass-production process.

BRIEF DESCRIPTION OF THE DRAWINGS

Other features of the invention will be more apparent upon consideration of the following description and accompanying drawings, wherein.

DETAILED DESCRIPTION OF THE INVENTION

Figure 1:
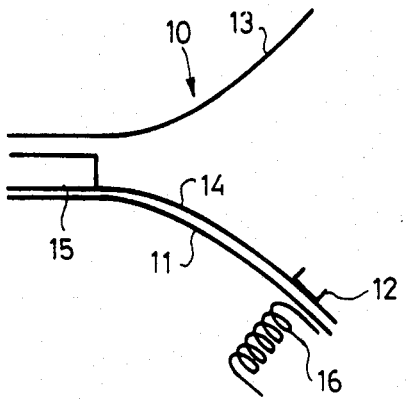
FIG. 1 is a diagram of part of a cathode-ray tube at the time of manufacture.

The example described below relates to the manufacture of a color television picture tube of the shadow-mask type.

During the final stages of manufacture of a cathode-ray tube 10 and just after evaporation of the glass envelope 11, evaporation of the getter material is carried out in order to distribute said material over all the glass walls. This getter material consists of a barium pellet placed in a cup 12 located within the conical or flared portion 13 of the envelope 11 which is attached by means of a rod 14 to the envelope of the electron gun unit 15.

Heating of the barium for evaporation is performed by means of an induction coil 16 placed outside the envelope 11 but in the vicinity of the cup 12. The frequency and power of the supply to the coil 16 are such that the temperature of the cup can attain a value within the range of 800° C. to 1100° C.

Figure 2:
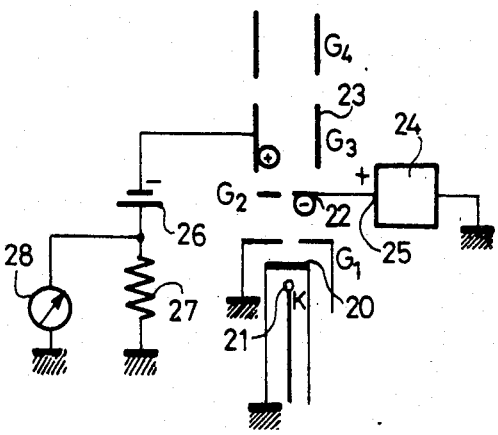
FIG. 2 shows an electron gun of a cathode-ray tube and current and voltage sources employed for carrying out the method in accordance with the invention.

After evaporation of the barium, the next step consists in forming and stabilizing the material which constitutes the cathode 20 (shown in FIG. 2). Said cathode 20 usually comprises a tube of nickel and the electron emission material consists of a mixture of barium, strontium and calcium oxides.

For the purpose of forming and stabilizing the cathode material, the cathode heating filament 21 is heated to a temperature which is higher than the usual operating temperature.

Formation or activation of the cathode is carried out over a period of approximately four minutes. This activation period is in turn divided into two stages of approximately equal duration. During the first stage, the cathode material is heated to a temperature of approximately 1000° C. During the second stage, said material is heated to a higher temperature of the order of 1070° C.

Stabilization of the cathode material is carried out over a period of approximately fourteen minutes. At the time of said stabilization, the cathode material is heated to a temperature of about 1000° C. During these stages of manufacture of the picture tube, gases such as carbon monoxide CO, carbon dioxide $CO_2$, methane $CH_4$ and others are evolved within the tube, in particular at the time of activation. These gases contain positive and negative ions in equal proportions from an electrical standpoint. The positive (+) ions are particularly harmful for the cathode since this latter is brought to a negative potential, attracts the positive charges, and is thus liable to incur damage. The getter material which is distributed over the walls of the envelope 11 absorbs the evolved gases both at the time of formation of the cathode material and at the time of subsequent degassing treatments.

The checking operation in accordance with the invention for ascertaining that the barium contained in the cup 12 has been correctly evaporated consists in measuring the pressure of gas within the cathode-ray tube after formation of the cathode material, during the period of stabilization of this material. Said gas pressure is measured prior to the subsequent operation of degassing or controlled aging.

Measurement of the gas pressure is performed by determining the positive ion charge. This operation will now be described. Approximately ten minutes after the beginning of activation of the cathode material or in other words during the stabilization period, a positive potential is applied to the second grid 22 designated by the reference $G_2$ by connecting this latter to the positive potential terminal 25 of a constant-current generator 24 and a negative potential is applied to the third grid 23 designated by the reference $G_3$ by connecting the negative terminal of a voltage generator 26 to said grid $G_3$. The source 26 delivers a voltage of 22.5 volts in the example considered.

A resistor 27 having a value of 100 kilohms, for example, is placed between the positive-potential terminal of the source 26 and ground. A voltmeter 28 is connected in parallel with said resistor 27. The voltage measured by said voltmeter represents the intensity of the current which passes through the resistor 27 or in other words which is delivered by the grid $G_3$. During this pressure-checking stage which involves measurement of the positive-ion charge within the tube, the first grid designated as $G_1$ is connected to ground as is the case with the cathode 20.

The positive ions are attracted by the grid 23 which has been brought to a negative potential whilst the negative ions are attracted to the grid $G_2$, 22 which has been brought to a positive potential. Thus the current which flows through the resistor 27 and is measured by the voltmeter 28 represents the positive-ion charge within the envelope 11 and therefore the total pressure.

Figure 4:
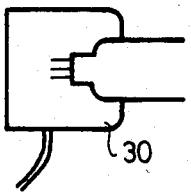
FIG. 4 is a diagram showing the rear portion of a cathode-ray tube during one stage of manufacture.

The connection of the source 26 and of the generator 24 to the respective grids is established by means of a socket 30 (as shown in FIG. 4), namely the socket normally employed for making the connections which serve to form the cathode material and to carry out the degassing treatments.

Figure 3:
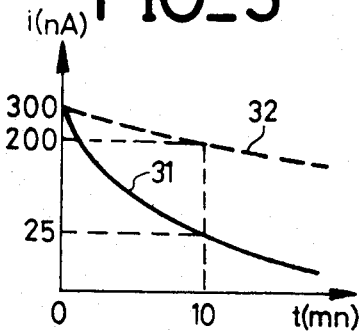
FIG. 3 is a diagram which provides an explanatory illustration of the method in accordance with the invention.

If the barium has been correctly evaporated, the intensity i of the current within the resistor 27 varies as a function of the time interval t as represented by the full-line curve 31 (shown in FIG. 3). Immediately after formation of the cathode at the instant t=0, the current has an intensity of the order of 300 nanoamperes. At the end of a period of the order of ten minutes, this intensity has fallen to a value of 25 nanoamperes. On the other hand, if the barium has not been evaporated, the intensity i varies in accordance with the dashed-line curve 32. At the end of a time interval of approximately ten minutes (t=10 mins), this intensity has a value of the order of 200 nanoamperes.

Accordingly, if the intensity i of the current within the resistor 27 exceeds 150 nanoamperes, the cathode-ray tube is returned to the induction heating station in order to evaporate the barium pellet. On the other hand, if the intensity is below 150 nanoamperes, the tube remains on the production line in order to undergo the degassing treatment. In one example, if the current intensity i exceeds 150 nanoamperes, the socket 30 is separated from the cathode-ray tube 10 but this latter remains in the production line with the other tubes until completion of the degassing treatment. However, the tube which is not fitted with a socket 30 undergoes none of the treatments involving final stabilization of the cathode material, degassing or aging. In this example, the tube is returned to the induction heating station after the degassing period although it has not been subjected to this treatment.

A comparison with the value of 150 nanoamperes can be made by an operator. It is also possible to provide a comparator for delivering a signal when the current intensity exceeds said predetermined value. This signal can actuate visual or sound alarm means. Said signal can also be employed for controlling the operation of a mechanism for extracting the socket 30.

What is claimed is:

1. A method for manufacturing a cathode-ray tube, comprising:

evaporating a pellet of getter material on the walls of said tube;

forming and stabilizing a cathode of said cathode-ray tube;

monitoring to assure evaporation of said getter material during said step of forming and stabilizing of said cathode by measuring the pressure within the cathode-ray tube by measuring the positive ions exchanged within the cathode-ray tube during forming and stabilizing of said cathode, including, applying potentials of opposite signs to electron-gun grids which are separate from the cathode during forming and stabilizing of said cathode, said potentials having values such that no positive ions impinge on said cathode during forming and stabilizing of said cathode, and measuring the positive ion charge based on the intensity of a current which flows in a circuit which does not include the cathode during forming and stabilizing of the cathode.

2. A method according to claim 1, wherein a positive potential is applied to the grid $G_2$ and a negative potential is applied to the grid $G_3$, the measured current intensity being that of the current which flows between the grid $G_3$ and ground.

3. A method according to claim 1, wherein the application of said potentials to the grids of the electron gun is carried out by means of a socket which is also employed for establishing the electric connections when forming the cathode material and carrying out the degassing treatments.

4. A method according to claim 3 wherein, if the pressure is higher than the predetermined value, the socket is separated from the cathode-ray tube and said tube is returned subsequently to the getter-material evaportion station.

5. A method according to claim 1, wherein the positive potential applied to one of the grids of the electron gun is delivered by a constant-current generator.

6. A method according to claim 1, wherein the measurement of pressure is carried out approximately ten minutes after the beginning of the operation involving formation of the cathode material.

7. Application of the method according to claim 1 to the manufacture of a cathode-ray tube, wherein the measured pressure is compared with a predetermined value and wherein said tube is returned to the getter-material evaporation station if said pressure is higher than the predetermined value.

8. A method according to claim 7, wherein the predetermined value is of the order of $2\times10^{-4}$ Torr.

* * * * *